United States Patent [19]

Kille et al.

[11] 4,393,993

[45] Jul. 19, 1983

[54] SPRAY GUN

[75] Inventors: Ewald Kille; Guido Zimmermann, both of Friedrichshafen, Fed. Rep. of Germany

[73] Assignee: J. Wagner GmbH, Fed. Rep. of Germany

[21] Appl. No.: 267,666

[22] Filed: May 27, 1981

[30] Foreign Application Priority Data

May 30, 1980 [DE] Fed. Rep. of Germany ..... 3020539

[51] Int. Cl.[3] ..... B05B 9/04

[52] U.S. Cl. ..... 239/332; 222/333; 239/333

[58] Field of Search ..... 239/332, 333; 222/333

[56] References Cited

U.S. PATENT DOCUMENTS

| | | | |
|---|---|---|---|
| 1,881,963 | 10/1932 | Perrin | 239/333 |
| 2,494,837 | 1/1950 | Simmons | 239/333 |
| 2,704,690 | 3/1955 | Eichenauer | 239/332 |
| 3,116,879 | 1/1964 | Wagner | 239/332 |
| 3,288,375 | 11/1966 | Conover | 222/333 |
| 3,565,344 | 2/1971 | Takei | 239/332 |
| 3,899,134 | 8/1975 | Wagner | 239/332 |
| 3,993,250 | 11/1976 | Shure | 239/332 |
| 4,030,665 | 6/1977 | Koyama | 239/332 |
| 4,160,525 | 7/1979 | Wagner | 239/332 |
| 4,162,037 | 7/1979 | Koyama | 239/332 |
| 4,189,098 | 2/1980 | Wagner et al. | 239/332 |

FOREIGN PATENT DOCUMENTS

| | | | |
|---|---|---|---|
| 2336986 | 2/1975 | Fed. Rep. of Germany . | |
| 2337039 | 2/1975 | Fed. Rep. of Germany . | |
| 2653981 | 8/1979 | Fed. Rep. of Germany . | |
| 1017606 | 12/1952 | France | 239/332 |

*Primary Examiner*—John J. Love

*Assistant Examiner*—Michael J. Forman

*Attorney, Agent, or Firm*—Hill, Van Santen, Steadman, Chiara & Simpson

[57] ABSTRACT

A hand held household or hobby type spray gun is provided with a pistol grip housing having a transverse bore receiving a removable piston pump and nozzle assembly, suspending a removable container for the medium to be sprayed, and covered by a removable cap enclosing an electric motor for driving the piston of the pump. The pump and nozzle assembly is locked in the bore by a quarter turn rotation which seats a detent in a recess of the bore. The electric motor is energized from an external power source through a cord carried by the cap or from batteries which may be mounted in a chamber provided by the grip or handle portion of the housing. The housing may be a one-piece injection mold plastics material member, and the removable container for the media to be sprayed as well as the closure gap for the motor may also be injection mold plastic material members. The grip or handle portion of the housing span the rear side of the spray gun and has a front recess embracing the container. The pump portion of the housing overlies the handle portion and extends at right angles thereto with lateral or side grooves in its outer face to receive the fingers of the hand of an operator grasping the handle. A motor actuating button is mounted in one of the recesses. The assembled spray gun is a canister of rectangular shape with rounded corners preferably having a generally cylindrical front face with the pump nozzle projecting from the apex thereof while the electric cord projects from the rear face of the cover or cap. The components of the spray gun are easily disassembled to accommodate cleaning, replacement of worn parts and the like.

14 Claims, 10 Drawing Figures

SPRAY GUN

BACKGROUND OF THE INVENTION

1. Field of The Invention

This invention relates to a pump driven spray gun having a one-piece housing providing a handle, a chamber for removably receiving a pump assembly, a removable electric motor carrying cap mounted on top of the housing, and a removable container suspended from the housing. Specifically, this invention deals with a hand held canister type spray gun having a one-piece molded plastics material housing providing a pistol grip spanning the rear side thereof, a hollow horizontal portion removably receiving a piston pump and spray nozzle unit, a removable top cover housing an electric motor for driving the piston of the pump, and a removable suspended container embraced by the grip.

2. Prior Art

Hand held motor driven spray guns with suspended removable container are known in the art in a plurality of various embodiments. For example, in German L.P. No. 2,653,981, corresponding with U.S. Pat. No. 4,160,525, issued July 10, 1979, a spray gun has a pump housing providing a pistol grip removably mounting a pump while supporting a supply receptacle, but a U-shaped sheet metal bridge is required to mount the pump and the drive motor. Comparable embodiments are also disclosed in German Pat. No. 2,337,039, corresponding with U.S. Pat. No. 3,899,134, issued Aug. 12, 1975 and German Pat. No. 2,336,986. The prior art spray guns are designed for large discharge outputs of over 120 $cm^3$/min, and are too expensive for household use in spraying small areas, and are not suitable for hobby and model building due to their size and shaping.

It would, therefore, be an improvement in the art to provide a hand held electric motor driven spray gun wherein the parts are easily removed for replacement, repair and cleaning and which is small and light enough to be easily operated and gripped in the hand of a user and which can be economically manufactured and sold in a low-cost market for output capacities of only about 40 to 70 $cm^3$/min.

SUMMARY OF THE INVENTION

This invention now provides a spray gun with a central housing section having an upright handle portion extending along its length and across its width, a horizontal portion with a central bore removably receiving a piston pump unit, top removable cover mounting an electric motor for driving the pump piston, and suspending a removable supply receptable. This housing is in one piece and may be injection molded from suitable plastics material.

The central housing has an exterior generally rectangular transverse contour with rounded edges providing a front end face of generally semicircular section receiving the pump assembly and a nozzle head carried by the pump assembly and having finger receiving depressions or grooves in the lateral faces thereof cooperating with the vertical handle to provide a comfortable grip. This central housing also mounts an actuating button in a lateral face thereof forwardly of a finger receiving groove to be easily depressed by the finger of a user.

The pump cylinder of the pump assembly is introduced into the bore of the housing and rotated 90° into locked position. In its locked position, the cylinder registers with a supply tube depending into the container.

The cap preferably has a tongue engaged in a groove provided in the top of the center section housing. The bottom of the horizontal portion of the central housing can have threads or similar locking tongues and grooves to suspend the supply container.

The stator of a motor in the cap may have mounting pins engageable in grooves or recesses provided in the top of the center housing section and where the motor has an oscillating armature, a stop can be provided opposite the piston engaging portion to limit the stroke of the piston.

In an embodiment where a rotary motor is provided to drive the piston, the center section can have a support penetrated by the drive shaft of the motor which will engage the piston assembly.

The handle portion of the central section spans the rear side of the supply container and extends along the full length of the container having a recess in its front face to receive the rear side face of the container. This vertical portion or handle portion of the center housing is hollow and may house rechargeable batteries to energize the electric motor.

The spray gun of this invention has a simple structural design, is easily manufactured and assembled, is unsusceptible to malfunction and is easy to handle. The center section of the gun not only provides a handle, but also provides a mounting for a replaceable piston pump. The assembling or stacking of the components of the spray gun make possible a very compact assembly where the parts are easily exchanged. The manufacturing costs of the spray guns of this invention are minimal, and the device is easy to handle.

Further objects and details of the spray gun of this invention will become apparent to those skilled in this art from attached drawings which are made a part thereof and in which:

AS SHOWN ON THE DRAWINGS

Figure 2:
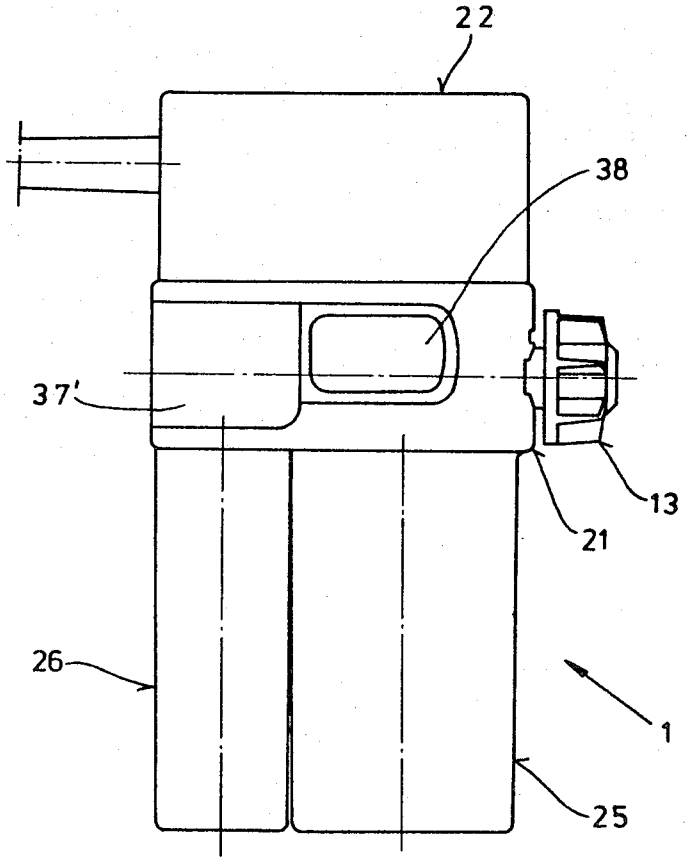
FIG. 2 illustrates the spray gun of FIG. 1 viewed from the opposite side.
Figure 1:
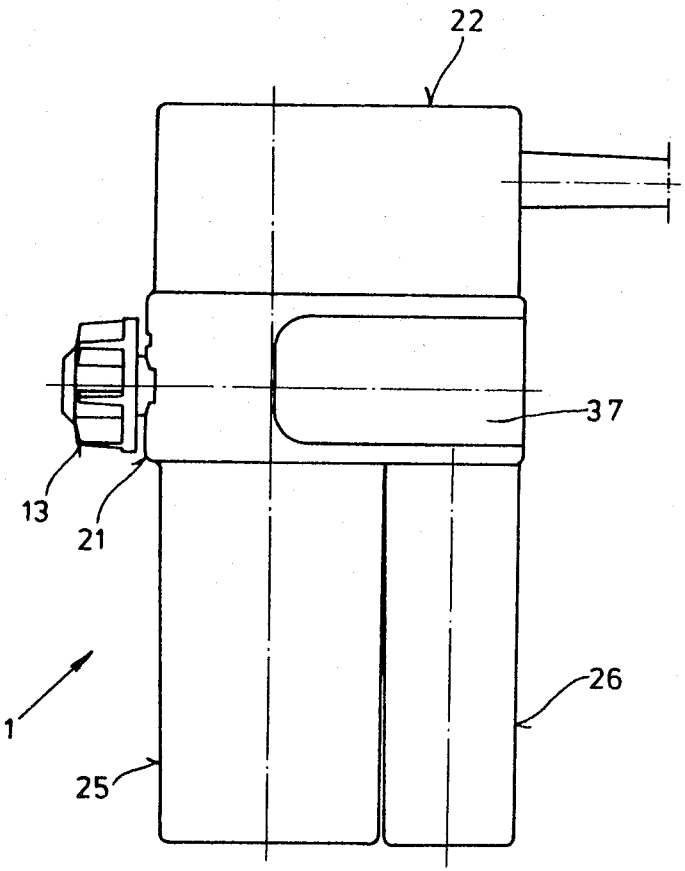
FIG. 1 is a side elevation or lateral view of a spray gun of this invention.
Figure 5:
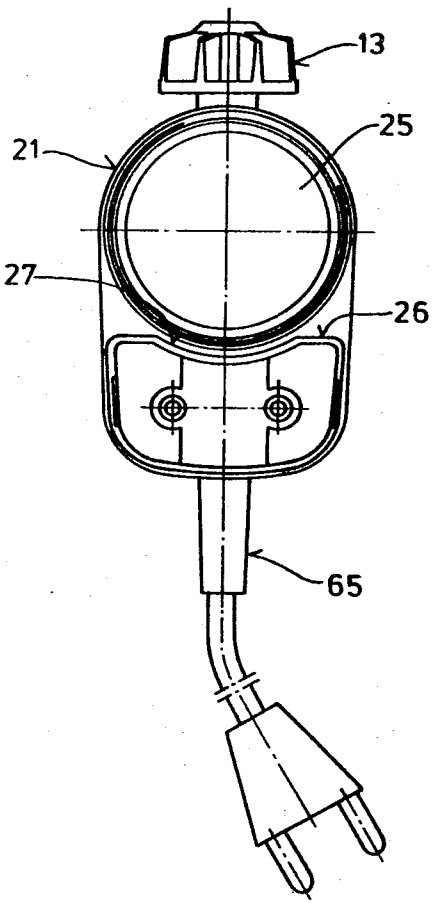
FIG. 5 illustrates the spray gun of FIG. 1 from the bottom.
Figure 4:
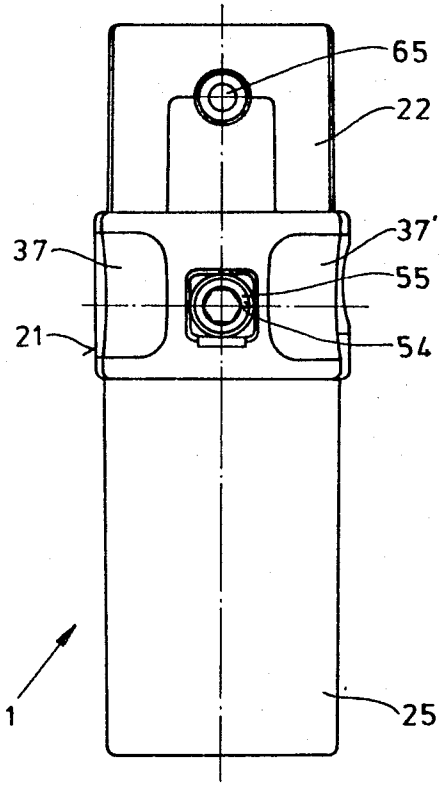
FIG. 4 illustrates the spray gun of FIG. 1 from the back.
Figure 3:
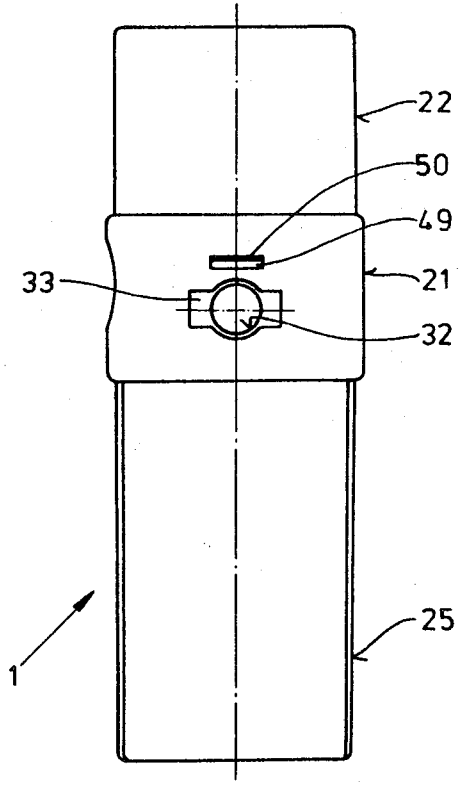
FIG. 3 illustrates the spray gun of FIG. 1 from the front without the inserted pump.

The spray gun 1 of FIGS. 1 through 8 is designed as a self-contained hand held device. It has a generally rectangular central or main housing portion 21 provided with rounded corners and having a horizontal portion with a bore removably receiving a piston pump assembly 2. A cover or lid 22 is mounted on the housing 21 and an electric drive motor 23 (FIG. 6) or 24 (FIG.

8) is mounted in the cover. A supply container 25 is suspended from this horizontal housing section and mounted thereon by a threaded attachment 58. The center section 21 has an integral hollow handle portion 26 with a fragmental cylindrical depression 27 in the front face thereof partially embracing the supply container 25. The hollow upright portion 26 is closed by a cap 28 and thus provides a chamber which can receive rechargeable batteries for driving the motor 23 or 24.

The center section 21 has the horizontal portion 31 thereof provided with a longitudinal bore 32 in which the cylinder 3 of the piston pump assembly is engaged. The center section 21 with its profile 31 and dependent portion 26 is preferably molded in one piece from suitable plastics material.

The pump cylinder 3 has a bushing 5 receiving a piston 4 driven by the armature 62 of the electric motor 23 which, as illustrated, is in the form of an alternating current oscillating magnet with an armature 62 acting on the piston 4 through a pressure part 9 spring loaded by return spring 10 so that during a suction stroke, the medium to be sprayed is drawn into the pressure chamber 6 through a bore 11 and during a pressure stroke, is forced out through a spray nozzle 13 screwed onto the pump cylinder 3. During this suction stroke, the exhaust port of the pressure chamber 6 is closed by a valve body 7 spring loaded by a spring 8. A return bore 12 is provided in the bushing 5.

The pump cylinder 3 is easily locked in the bore of the center section 21 which is provided with a detent groove 34 receiving a detent attachment 43 on the pump cylinder 3. The pump cylinder 3 is then introduced into the bore 32 through the detent groove 34, the end face receiving the nozzle 13. A groove 33 is offset 90° from the groove 34, and the pump cylinder 3 is then merely rotated 90° to lock the detent 43 in the groove 34.

A suction tube 46 is inserted in the bore 47 of the central section 21 and into the bore 45 of a pump cylinder 3 after it is locked in position in the center section 21. A supply channel 44 in the center section 21 cooperates with the tube 46 to supply the media to be sprayed to the pump cylinder 3. The return vent 12 of the bushing 5 registers with a return bore 48 to discharge back to the container 25.

The stator 61 of the electromotor 23 is supported between projecting bars 35 molded onto the central section 21 and cooperating with additional bars 36. The bars 35 have slots 59 cooperating with pins 68 on the stator 62 to removably mount the stator on the section 21. The stator 61 is also secured in position in the cover 22 by a compression spring 53 supported on the stator 62 and engaging the top of the cover 22. The cover 22 is supported on the center section 21 by a tongue 50 seated in a detent groove 49 at the nozzle face side of the cover. The other end of the cover is held on the section 21 by screws 52 traversing the cover 22 and threaded into eyes 51 projecting upwardly from the center section. The cover 22 rests on the eyes 51 and is fixedly mounted to the center section 21, although it is readily removed by unthreading the screws 52 and removing the tongue 50 from the groove 49.

The stroke of the armature 62 is limited by a stop 63 inserted in the center section 21 and supported by means of a screw 55 in a recess 54. A cap 56 closes the recess 54. Electrical parts, generally referenced with the numeral 64, supplied by current through a cord 65, are provided above the recess 54.

Figure 8:
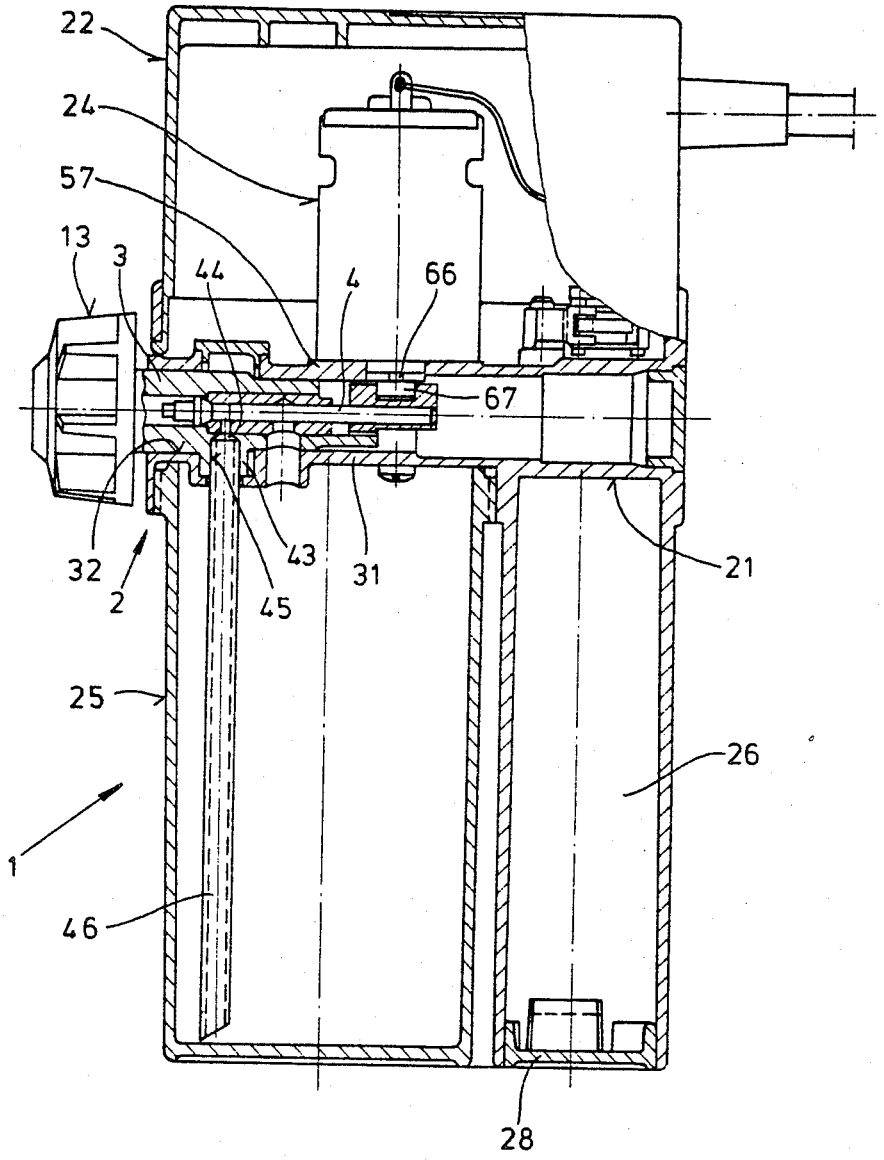
FIG. 8 is a view similar to FIG. 6, but illustrating a modified embodiment.
Figure 9:
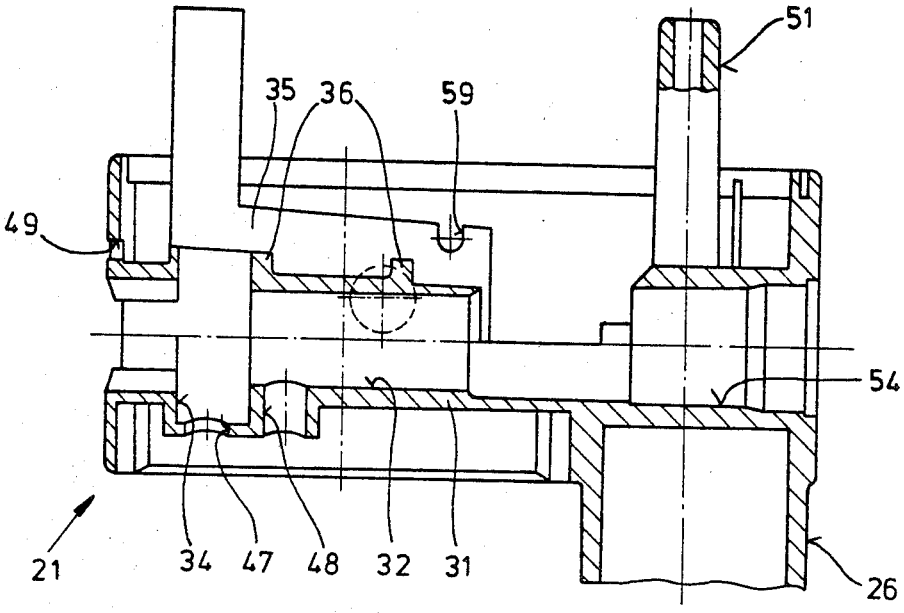
FIG. 9 is a section of a portion of the center housing.
Figure 10:
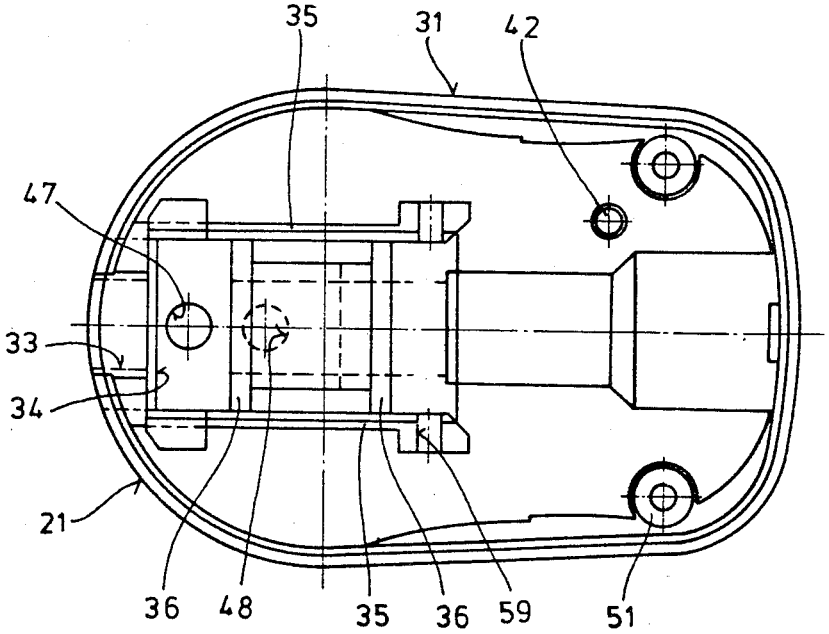
FIG. 10 is a plan view of the housing portion of FIG. 9.

The motor 24, as shown in FIG. 8, is mounted on a support 57 of the center section 21 and has a drive shaft 66 acting through an eccentric 67 on the piston 4 of the pump 2.

Figure 6:
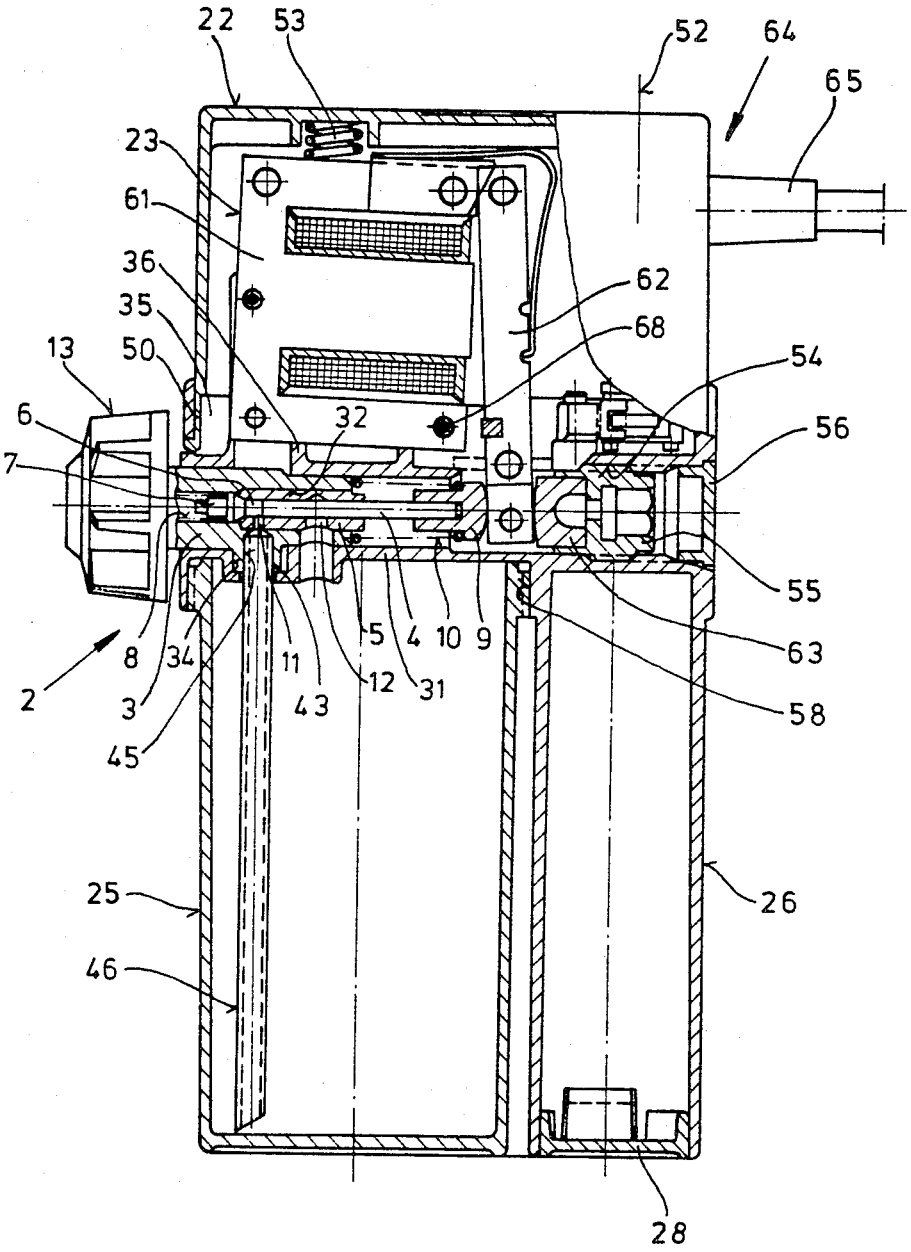
FIG. 6 illustrates the spray gun of FIG. 1 in an axially vertically section.
Figure 7:
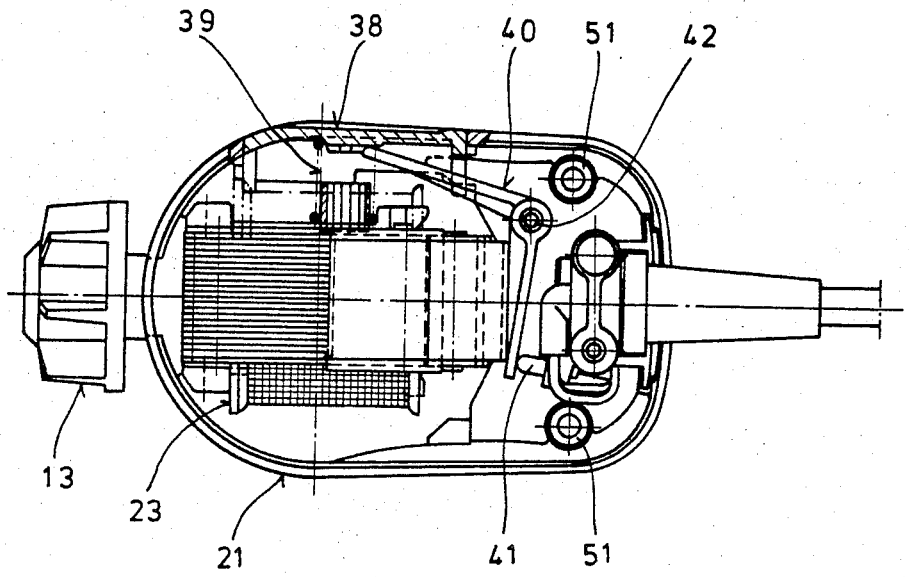
FIG. 7 illustrates the spray gun of FIG. 1 from the top with the cover removed.

For energizing the motor 23 of FIG. 6 or the motor 24 of FIG. 8, a switch 41 actuated by a button 38 spring biased by a spring 39 in the center section 21 actuates a shift lever 40 on a pin 42. The button 38 is formed in one of the depressions 37 or 37′ on the longitudinal sides of the center piece and as is explained above, it is merely necessary to place a finger in these depressions and to squeeze the button for energizing the motor. The motor 23 or 24 is thus easily controlled from the fingers of the hand of the user grasping the handle.

It will be understood that many variations from the illustrated embodiments shown on the drawing, can be made without departing from the scope of the invention as defined by the hereinafter dependent claims.

We claim as our invention:

1. A hand held spray gun and supply unit which comprises a center housing section in the form of an inverted L-shaped member having a horizontal top leg with top and bottom faces and a peripheral side wall, said top leg having a front to rear longitudinally extending bore and a vertical hollow hand grip leg depending from the rear portion of the horizontal leg with a fragmental cylindrical recessed front face along the length thereof under the horizontal leg, a pump assembly removably mounted in said bore including a pump cylinder in said bore and a nozzle overlying the peripheral side wall of the horizontal leg at the front of the bore communicating with said cylinder, said cylinder having an intake extending through the bottom face of said horizontal leg, a piston reciprocally mounted in said cylinder to pump fluid from the intake through the nozzle, a cylindrical supply container removably suspended from the bottom face of said horizontal leg embraced by the vertical leg in the recessed front face thereof, an electric motor mounted on the top face of said horizontal leg driving said piston, said hollow vertical leg providing a chamber adapted to receive a battery to energize said motor, a switch on the top face of said horizontal leg having an actuating button accessible at the peripheral side wall of said horizontal leg, a removable cover on said horizontal leg enclosing said motor and switch, and a tube depending from the bottom face of the horizontal leg into the container for supplying fluid from the bottom of the container to said intake for discharge through said nozzle.

2. The unit of claim 1 wherein the vertical hand grip leg has side walls and the cylindrical supply container has a side wall substantially flush with the side walls of said vertical leg.

3. The unit of claim 1 wherein the pump cylinder of the pump assembly is introduced into the front end of the bore of the horizontal top leg and is rotated into locked position in said bore.

4. The unit of claim 1 wherein the peripheral side wall of the horizontal leg extends above the top face of the leg and the cover is embraced by said extended portion.

5. The unit of claim 1 including an upstanding pin on the top face of the horizontal leg, and a bell crank lever pivoted on said pin connecting the button with the switch.

6. The unit of claim 1 wherein the center housing section, the cover, and the container cooperate to provide a compact stacked assembly of generally oval cross-section.

7. The unit of claim 1 wherein the container and the vertical leg have bottom walls in substantially flush relation.

8. A hand held spray gun and supply unit which comprises a one-piece molded plastics material housing in the shape of an inverted L having a top horizontal leg with top and bottom faces and a peripheral side wall, said horizontal leg having a front-to-rear longitudinal bore and a hollow hand grip vertical leg depending from the rear portion of the horizontal leg, said vertical leg having a recessed front face, a back face and side faces, a piston pump assembly mounted in the bore of said horizontal leg with a discharge nozzle overlying the peripheral side wall of the horizontal leg at the front of the bore, a pump cylinder in said bore and a reciprocal piston in said pump cylinder, an open top container removably suspended from the bottom face of said horizontal leg and embraced by said hand grip vertical leg in the recessed front face forwardly of the back face and flush with the side faces thereof, said pump cylinder having an inlet communicating through the bottom face of said horizontal leg with the interior of said container, a cover overlying the top face of said horizontal leg, an electric motor mounted on said horizontal leg in said cover driving said piston, a switch mounted on said horizontal leg having a button accessible to the finger of the hand of an operator grasping the hand grip and said hollow vertical leg providing a battery chamber to house a battery for energizing said motor.

9. The unit of claim 8 wherein the button is mounted in the peripheral side wall of the horizontal leg forwardly of the vertical leg above the container.

10. The unit of claim 8 wherein the hollow vertical leg has an open bottom and a removable closure closes said bottom.

11. The unit of claim 8 including a return vent from the pump cylinder through the bottom face of the horizontal leg communicating with the container.

12. The unit of claim 8 including an electrical contact for an electrical cord projecting through the cover.

13. The unit of claim 8 wherein the cylinder of the pump assembly is introduced into the front end of the bore and is rotated into locked position in the bore.

14. The unit of claim 8 wherein a bushing in the pump cylinder slidably supports the piston.

* * * * *